US006588493B1

(12) United States Patent
Bleide et al.

(10) Patent No.: US 6,588,493 B1
(45) Date of Patent: Jul. 8, 2003

(54) MODEL-BASED SYSTEM FOR DETERMINING CASTING ROLL OPERATING TEMPERATURE IN A THIN STRIP CASTING PROCESS

(75) Inventors: Walter Bleide, Brownsburg, IN (US); Rama Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 10/027,495

(22) Filed: Dec. 21, 2001

(51) Int. Cl.[7] ..... B22D 11/18; B22D 11/22

(52) U.S. Cl. ..... 164/453; 164/454; 164/455; 164/480; 164/154.4; 164/154.7; 164/155.5; 164/155.6; 164/155.2

(58) Field of Search ..... 164/453, 454, 164/455, 480, 154.4, 154.7, 155.5, 155.6, 155.2, 413, 414, 428, 150.1, 151.4, 151.3, 151.1

(56) References Cited

U.S. PATENT DOCUMENTS

| | | | | | |
|---|---|---|---|---|---|
| 4,674,556 | A | * | 6/1987 | Sakaguchi et al. | 164/454 |
| 5,020,585 | A | * | 6/1991 | Blazek et al. | 164/452 |
| 5,031,688 | A | * | 7/1991 | Burgo et al. | 164/452 |
| 5,184,668 | A | | 2/1993 | Fukase et al. | 164/480 |
| 5,277,243 | A | | 1/1994 | Fukase et al. | 164/428 |
| 5,488,988 | A | | 2/1996 | Fukase et al. | 164/469 |
| 5,518,064 | A | * | 5/1996 | Romannowski et al. | 164/453 |
| 5,584,336 | A | * | 12/1996 | Romanowski et al. | 164/453 |
| 5,787,967 | A | | 8/1998 | Vendeville et al. | 164/452 |
| 5,934,359 | A | | 8/1999 | Strezov | 164/480 |
| 6,474,403 | B1 | * | 11/2002 | Nikolovski et al. | 164/452 |

FOREIGN PATENT DOCUMENTS

| | | |
|---|---|---|
| DE | 197 44 815 C1 | 3/1999 |
| EP | 0 913 218 A1 | 6/1999 |
| GB | 2 316 639 | 3/1998 |
| JP | 58-023545 | 2/1983 |
| JP | 58-023546 | 2/1983 |
| JP | 3-090250 | 4/1991 |
| JP | 9-225613 | 9/1997 |
| WO | WO 95/03144 | 2/1995 |

* cited by examiner

*Primary Examiner*—M. Alexandra Elve
*Assistant Examiner*—I.-H. Lin
(74) *Attorney, Agent, or Firm*—Barnes & Thornburg

(57) ABSTRACT

A model-based strategy is provided for determining casting roll operating temperature in a continuous thin strip casting process. A first temperature sensor produces a first temperature signal indicative of the temperature of cooling liquid supplied to the casting rolls and a second temperature sensor produces a second temperature signal indicative of the temperature of cooling liquid temperature exiting the casting rolls. A computer determines a heat flux value as a function of the first and second temperature signals, and computes the operating temperature of the casting rolls as a function of the heat flux value, the second temperature signal and a number of constants defined by fixed-valued operating parameters of the continuous thin strip casting process. A control strategy is also provided to modify one or more operating parameters of the continuous thin strip casting process as a function of the casting roll temperature.

13 Claims, 5 Drawing Sheets

MODEL-BASED SYSTEM FOR DETERMINING CASTING ROLL OPERATING TEMPERATURE IN A THIN STRIP CASTING PROCESS

FIELD OF THE INVENTION

The present invention relates generally to processes for continuously casting thin steel strip, and more specifically to systems for determining casting roll operating temperature and controlling one or more thin strip casting process parameters as a function thereof.

BACKGROUND OF THE INVENTION

It is known to cast metal strip by continuous casting in a twin roll caster. In such a process, molten metal is introduced between a pair of contra-rotated horizontal casting rolls which are cooled so that metal shells solidify on the moving roll surfaces and are brought together at the nip between them to produce a solidified strip product which is delivered downwardly from-the nip between the rolls. The molten metal may be introduced into the nip between the two rolls via a tundish and a metal delivery nozzle system located beneath the tundish so as to receive a flow of metal from the tundish and to direct it into the nip between the rolls, so forming a casting pool of molten metal supported on the casting surfaces of the rolls immediately above the nip. This casting pool may be confined between side plates or dams held in engagement with end surfaces of the rolls so as to dam the two ends of the casting pool against outflow, although alternative means such as electromagnetic barriers have also been proposed for this purpose.

When casting thin steel strip in a twin roll caster of the type just described, the molten steel in the casting pool will generally be at a temperature of the order of 1500° C. and above, and very high cooling rates are achieved over the surfaces of the casting rolls. To this end, the casting rolls are typically liquid cooled uniformly adjacent to their surfaces in order to promote rapid solidification of the thin metal strip. In the twin roll casting process, care must be taken to avoid excessive casting roll surface temperatures that may cause accelerated deterioration of the casting rolls, potentially leading to catastrophic explosions caused by leakage of the cooling liquid into the casting pool. Control of the surface temperature of the casting rolls is therefore critical to this thin strip casting process.

A primary obstacle to the successful control of casting roll surface temperature has been the difficulty in accurately measuring or estimating the surface or operating temperature of the casting rolls. Typical casting roll temperatures are of the order of 360° C. and above, and it is impractical to measure this temperature using currently available temperature sensors. Known techniques for estimating casting roll temperature, on the other hand, are bulky and not easily implemented with a computerized control system to provide on-line, instantaneous casting roll temperature information.

What is needed is a casting roll operating temperature determination system that is easily implemented in software and that accurately bases the casting roll operating temperature determination on easily measured operating conditions. Such a system would allow for on-line, real-time monitoring of casting roll operating temperature, and further provide a platform to implement casting roll operating temperature-based prognostic and diagnostic capabilities.

SUMMARY OF THE INVENTION

The foregoing shortcomings of the prior art are addressed by the present invention. In accordance with one aspect of the present invention, a method is provided comprising the steps of determining an inlet temperature ($T_I$) and an outlet temperature ($T_O$) of cooling liquid circulated through a cooling system of the at least one casting roll, computing a heat flux value (Q) as a function of the inlet and outlet temperatures, the heat flux value indicative of an amount of heat removed from the at least one casting roll by the cooling system, and computing the surface temperature of the at least one casting roll ($T_{ROLL}$) as a function of the heat flux value and the outlet temperature.

In accordance with another aspect of the present invention, a system is provided comprising a first temperature sensor producing a first temperature signal ($T_I$) indicative of temperature of cooling liquid entering a cooling system of the at least one casting roll, a second temperature sensor producing a second temperature signal ($T_O$) indicative of temperature of cooling liquid exiting the cooling system of the at least one casting roll, and a computer computing a heat flux value (Q) as a function of said first and second temperature signals, the heat flux value indicative of an amount of heat removed from the at least one casting roll by the cooling system, and computing the surface temperature of the at least one casting roll ($T_{ROLL}$) as a function of said second temperature signal and said heat flux value.

In accordance with a further aspect of the present invention, a method is provided comprising the steps of determining an inlet temperature ($T_I$) and an outlet temperature ($T_O$) of cooling liquid circulated through a cooling system of the at least one casting roll, computing a heat flux value (Q) as a function of the inlet and outlet temperatures, the heat flux value indicative of an amount of heat removed from the at least one casting roll by the cooling system, developing a correlation between the surface temperature of the at least one casting roll ($T_{ROLL}$), the heat flux value and the outlet temperature, mapping a first threshold surface temperature to a first threshold outlet temperature using the correlation, monitoring the outlet temperature, and generating a signal if the outlet temperature exceeds the threshold outlet temperature, the signal thereby indicative of the surface temperature of the at least one casting roll exceeding the first threshold surface temperature.

In accordance with yet another aspect of the present invention, a system is provided comprising a first temperature sensor producing a first temperature signal ($T_I$) indicative of temperature of cooling liquid entering a cooling system of the at least one casting roll, a second temperature sensor producing a second temperature signal ($T_O$) indicative of temperature of cooling liquid exiting the cooling system of the at least one casting roll, and a computer computing a heat flux value (Q) as a function of said first and second temperature signals, the heat flux value indicative of an amount of heat removed from the at least one casting roll by the cooling system, and correlating the surface temperature of the at least one casting roll ($T_{ROLL}$) to the heat flux value and the second temperature signal, said computer mapping a first threshold surface temperature to a first threshold outlet temperature using the correlation and generating a control signal if the second temperature signal exceeds the threshold outlet temperature, the control signal thereby indicative of the surface temperature The present invention provides a model-based system for determining casting roll operating temperature in a thin strip casting process.

The present invention also provides a thin strip casting control system for modifying one or more operating parameters associated with the steel casting process as a function of the casting roll operating temperature.

These and other objects of the present invention will become more apparent from the following description of the preferred embodiment.

DESCRIPTION OF THE PREFERRED EMBODIMENTS

Figure 1:
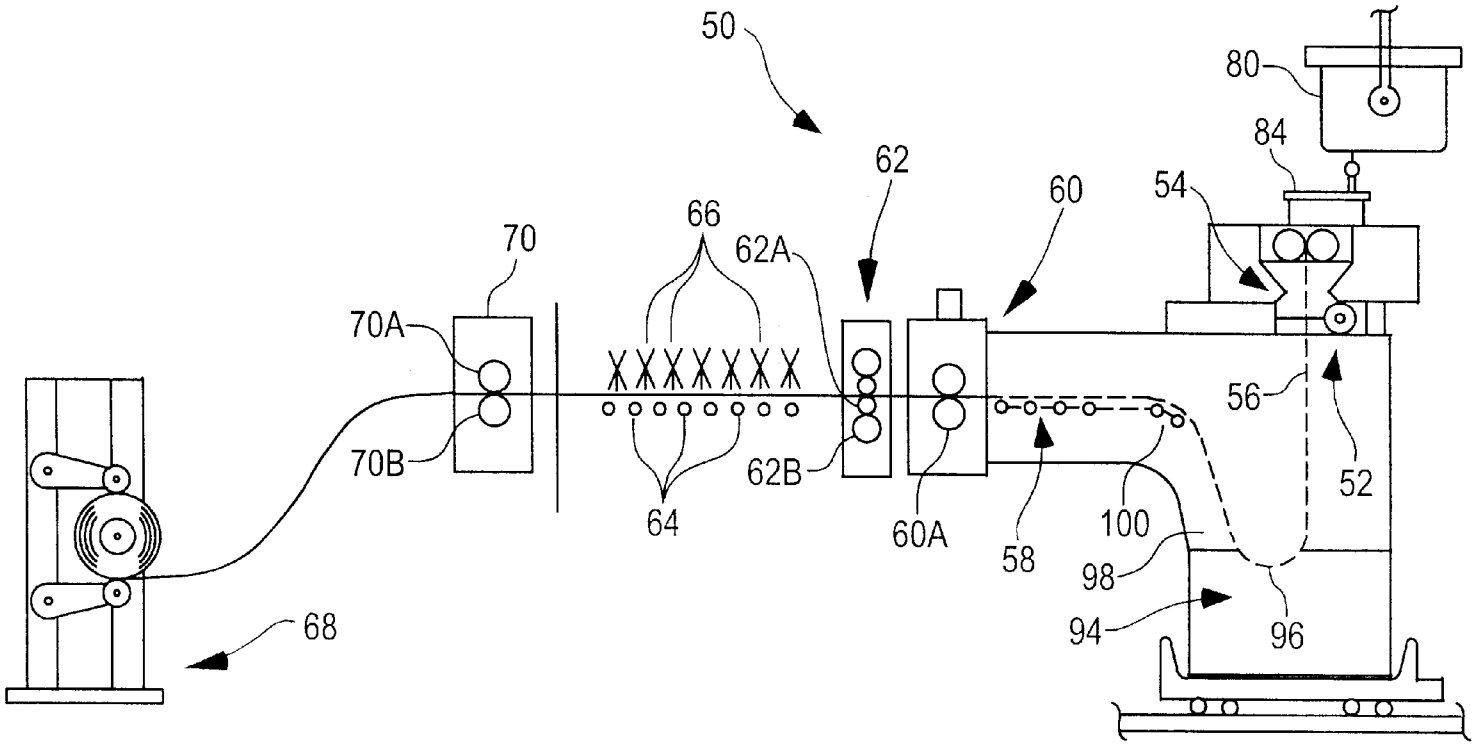
FIG. 1 is a diagrammatic illustration of one embodiment of a continuous thin strip casting apparatus.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

The present invention is based on producing steel strip in a continuous strip caster. It is based on extensive research and development work in the field of casting thin strip in a continuous strip caster in the form of a twin roll caster. In general terms, casting steel strip continuously in a twin roll caster involves introducing molten material between a pair of contra-rotated horizontal casting rolls which are internally liquid cooled so that metal shells solidify on the moving roll surfaces and are brought together at the nip between them to produce a solidified strip delivered downwardly from the nip between the rolls, the term "nip" being used to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in engagement adjacent the ends of the rolls so as to dam the two ends of the casting pool against outflow, although alternative means such as electromagnetic barriers have also been proposed. The casting of thin strip in twin roll casters of this kind is, for example, described in U.S. Pat. Nos. 5,184,668, 5,277,243 and 5,934,359, all of which are expressly incorporated herein by reference. Additional details relating to continuous thin strip casting of this type are described in co-pending U.S. patent application Ser. Nos. 09/967,163, 09/968,424, 09/966,184, 09/967,105, and 09/967,166, having Attorney Docket Nos. 29685-69008, 29685-69009, 29685-69010, 29685-69011 and 29685-68977 respectively, all of which are assigned to the assignee of the present invention and the disclosures of which are each expressly incorporated herein by reference.

Figure 2:
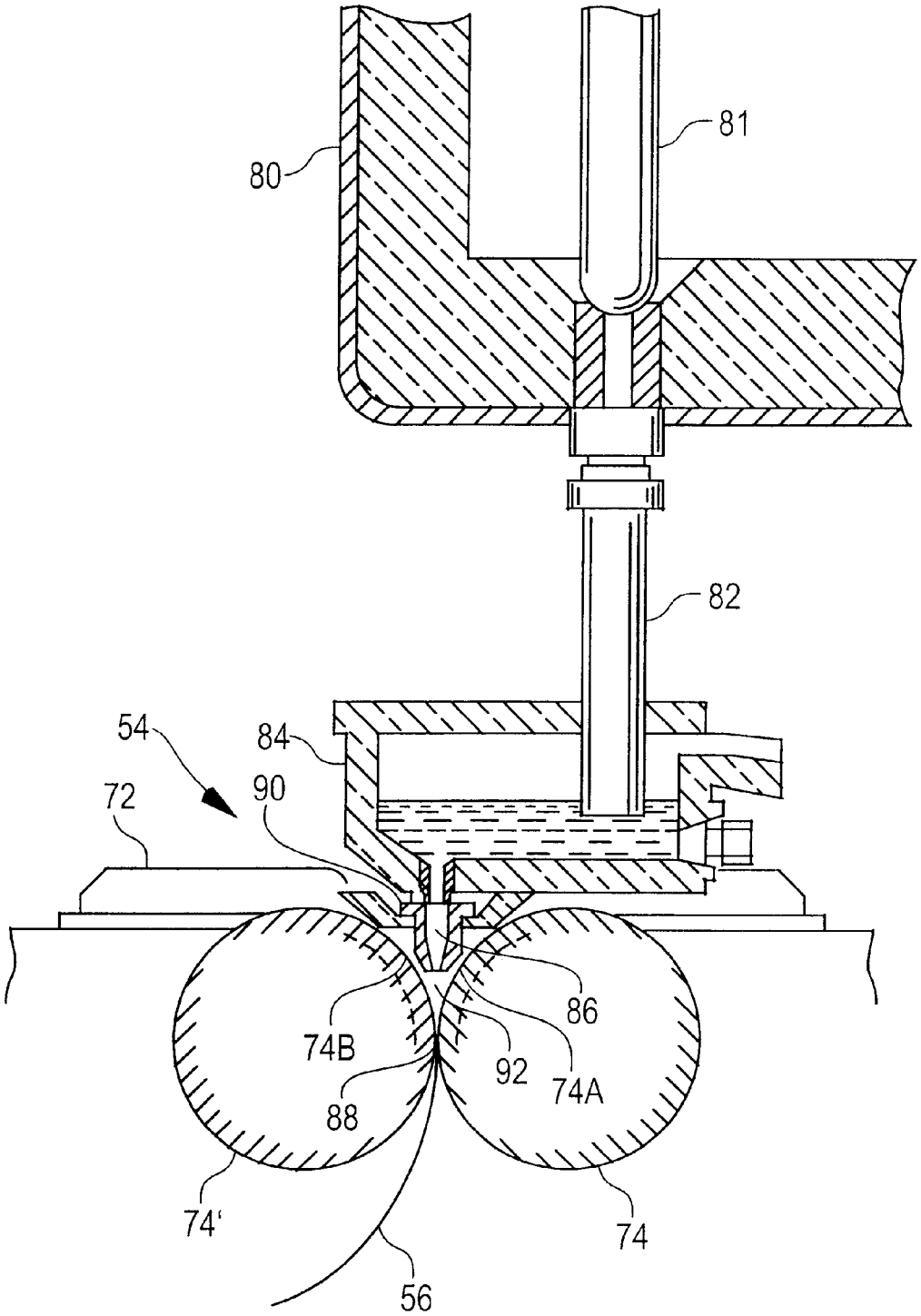
FIG. 2 is a diagrammatic illustration showing some of the details of the twin roll strip caster of the apparatus of FIG. 1.

Referring to FIG. 1, a continuous thin strip casting apparatus/process 50 is illustrated as successive parts of a production line whereby steel strip can be produced in accordance with the present invention. FIGS. 1 and 2 illustrate a twin roll caster denoted generally as 54 which produces a cast strip 56 that passes in a transit path 52 across a guide table 58 to a pinch roll stand 60 comprising pinch rolls 60A. Immediately after exiting the pinch roll stand 60, the strip passes into a hot rolling mill 62 comprising a pair of reduction rolls 62A and backing rolls 62B in which it is hot rolled to reduce its thickness. The rolled strip passes onto a run-out table 64 on which it may be force cooled by water jets 66 and through a pinch roll stand 70 comprising a pair of pinch rolls 70A and 70B, and thence to a coiler 68.

Referring now to FIG. 2, twin roll caster 54 comprises a main machine frame 72 which supports a pair of parallel casting rolls 74 and 74' having a casting surfaces 74A and 74B respectively. Molten material, e.g., molten metal, is supplied during a casting operation from a ladle (not shown) to a tundish 80, and from the tundish 80 through a refractory shroud 82 to a distributor 84 via control of a tundish valve 81. The molten metal is then passed through a metal delivery nozzle 86 into the nip 88 between the casting rolls 74 and 74'. Molten material thus delivered to the nip 88 forms a pool 92 above the nip 88 and this pool 92 is confined adjacent the ends of the rolls by a pair of side closure dams or plates 90 which are applied by a pair of thrusters (not shown) comprising hydraulic cylinder units connected to the side plate holders. The upper surface of pool 92 (generally referred to as the "meniscus" level) may rise above the lower end of the delivery nozzle 86 so that the lower end of the delivery nozzle 86 is immersed within this pool 92. The twin roll caster 54 may be of the kind which is illustrated and described in some detail in U.S. Pat. Nos. 5,184,668 and 5,277,243 or U.S. Pat. No. 5,488,988, the disclosures of which are each expressly incorporated herein by reference.

The casting rolls 74 and 74' are controllably cooled so that shells solidify on the moving roll surfaces and are brought together at the nip 88 between them to produce the solidified strip 56 which is delivered downwardly from the nip 88 between the rolls 74 and 74'. Although the present invention contemplates controllably cooling the casting rolls 74 and 74' in accordance with any known technique therefore, casting rolls 74 and 74' are, in one illustrative embodiment, cooled by way of a cooling system configured to direct cooling liquid therethrough as illustrated in FIGS. 3 and 4.

Figure 3:
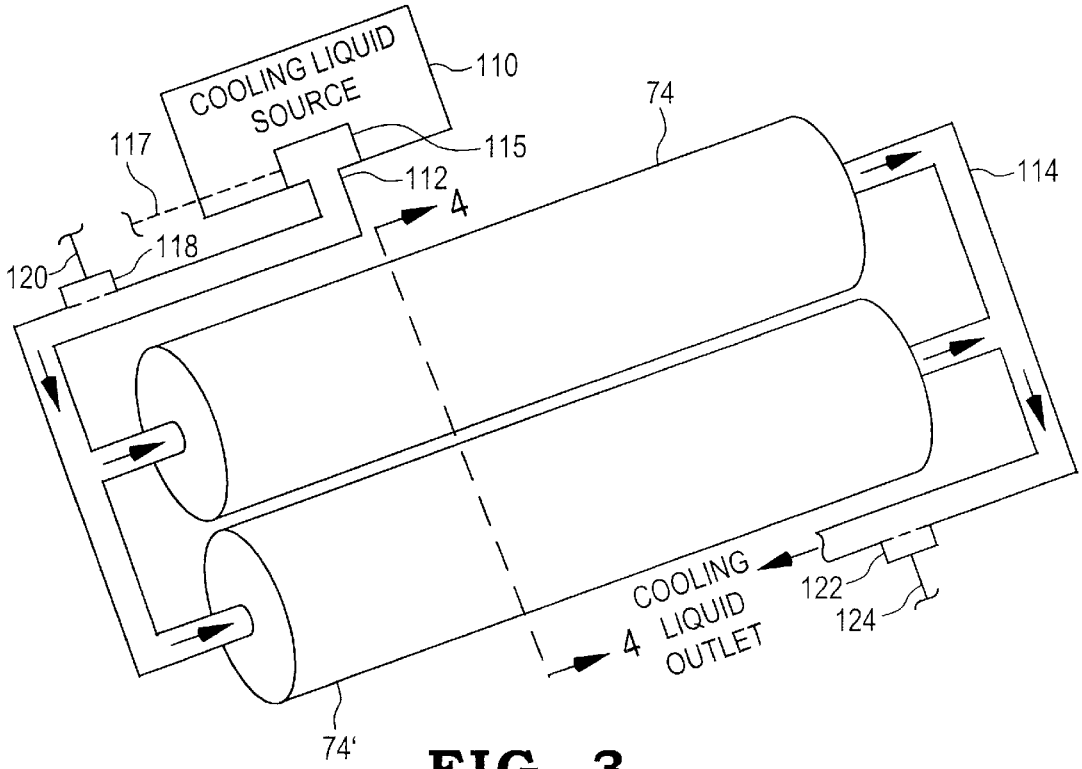
FIG. 3 is a perspective view of the twin casting rollers of FIGS. 1 and 2 illustrating a cooling system therefor.
Figure 4:
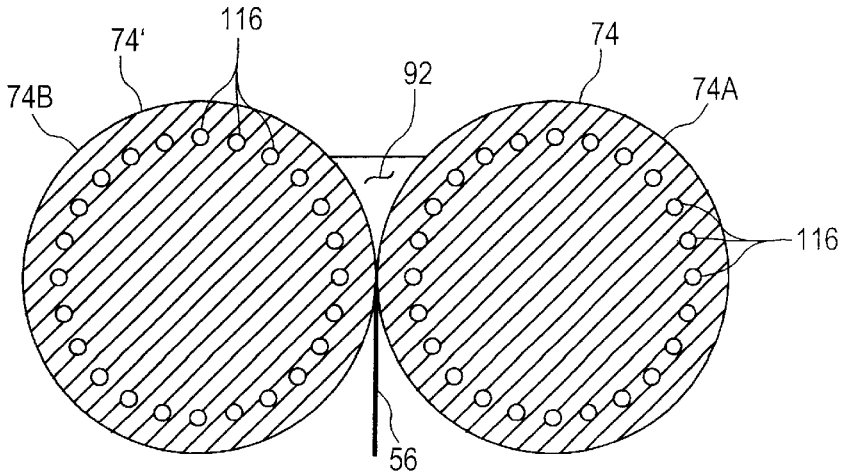
FIG. 4 is a cross-sectional view of the twin rollers viewed along section lines 4—4 of FIG. 3.

Referring to FIGS. 3 and 4, a source of cooling liquid 110 is fluidly coupled to liquid inlet ends of rolls 74 and 74' via inlet conduit 112, and liquid outlet ends of rolls 74 and 74' are fluidly-coupled to an outlet conduit 114. Each of rolls 74 and 74' define a number of liquid passageways 116 therethrough, wherein liquid passageways 116 are in fluid communication at one end of rolls 74 and 74' with inlet conduit 112, and at an opposite end of rolls 74 and 74' with outlet conduit 116. In one embodiment, liquid passageways 116 are arranged in circular fashion generally adjacent to surfaces 74A and 74B of rolls 74 and 74' respectively as illustrated in FIG. 4, although the present invention contemplates other configurations of liquid passageways 116.

In any case, liquid from the source of cooling liquid 110 is directed through conduit 112, through the liquid passageways 116 of each casting roll 74 and 74', and from rolls 74 and 74' through conduit 114. In one embodiment, the source of cooling liquid 110 is a cooling unit configured to supply chilled water. In this embodiment, outlet conduit 114 may be fluidly coupled at its free end to source 110 for re-cooling of the water passing through rolls 74 and 74'. Alternatively, the source of cooling liquid 110 may be a conventional well or municipal water utility station operable to supply pressurized water in a known manner. In this embodiment, outlet conduit 114 may be re-cycled or otherwise directed away from apparatus/process 50 in the form of waste water. Alternatively still, the cooling liquid supplied by source 110 may be a conventional coolant liquid of known chemical composition such as that typically used in cooling internal combustion engines, or other known coolant liquid. In this case, conduit 114 is fluidly coupled to source 110 for re-cycling and re-cooling of the coolant liquid. In any case, the flow rate of liquid through rolls 74 and 74' is controlled via conventional means.

Regardless of the type of cooling liquid used or the structural arrangement of cooling liquid source 110, inlet conduit 112 includes a first temperature sensor 118 of known construction in fluid communication therewith and electrically connected to a signal path 120. A second temperature sensor 122 of known construction is disposed in fluid communication with outlet conduit 114 and is electrically connected to a signal path 124. The temperature sensors 118 and 122 may each be positioned at any suitable location along conduits 112 and 114 respectively, wherein sensor 118 is operable to produce a first temperature signal indicative of the temperature of cooling liquid flowing from inlet conduit 112 into the liquid inlets of either, or both, of casting rolls 74 and 74', and sensor 122 is operable to produce a second temperature signal indicative of the temperature of cooling liquid flowing out of the liquid outlets of either, or both of, rolls 74 and 74' and through outlet conduit 114.

A cooling liquid flow rate mechanism 115 is disposed in-line with the flow of cooling liquid supplied by source 110 and is electrically connected to signal path 117. In one embodiment, mechanism 115 is a cooling liquid flow rate control mechanism of known construction and associated with the cooling liquid source 110 as illustrated in FIG. 3, wherein mechanism 115 may be controllably adjusted such that cooling liquid from source 110 is supplied to conduit 112 at a desired flow rate as is known in the art. In this embodiment, mechanism 115 also includes a conventional flow rate sensor that is operable to produce a flow rate signal on signal path 117 indicative of the flow rate of cooling fluid supplied from source 110 to conduit 112. In an alternative embodiment, mechanism 115 does not include a flow control component, and the flow rate of cooling liquid supplied by source 110 may accordingly fluctuate. In this embodiment, mechanism 115 is a conventional fluid flow sensor that may be disposed at any suitable location in fluid communication with the cooling liquid flowing from source 110, through conduit 112, through either of the casting rolls 74 or 74', and/or through conduit 114. The fluid flow rate sensor in either embodiment is operable to produce a flow rate signal on signal path 117 indicative of the flow rate of cooling fluid supplied from source 110 to conduit 112. In one embodiment, the fluid flow rate sensor may include an orifice plate having one pressure sensor disposed in fluid communication with liquid on one side of the plate and another pressure sensor in fluid communication with liquid on the other side of the plate, wherein the rate of fluid flow through the orifice plate is a well known function of the difference between the pressure signals produced by the two pressure sensors and the cross-sectional area of the flow orifice defined through the plate. It is to be understood, however, that the present invention contemplates alternatively utilizing other known fluid flow rate sensors or sensing systems, and such other sensors or sensing systems are intended to fall within the scope of the present invention. Thus, while flow rate mechanism 115 may or may not include a control mechanism for regulating the flow rate of cooling fluid supplied by source 110, it does in any case include a fluid flow rate sensor for monitoring the flow rate of cooling liquid flowing through the casting roll cooling system.

Figure 5:
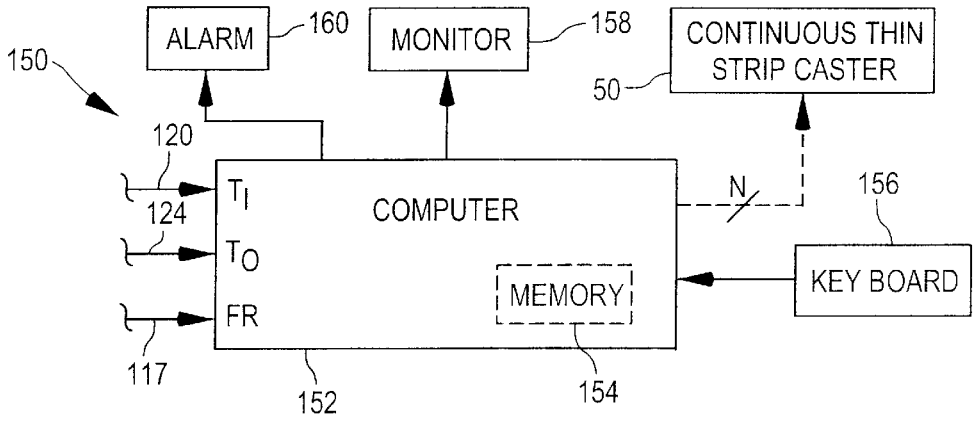
FIG. 5 is a block diagram illustration of a general purpose computer system operable to determine the operating temperature of at least one of the twin rollers shown in FIGS. 1–4 and to provide strip casting process control information as a function thereof.

Referring now to FIG. 5, one illustrative embodiment of a system 150 for determining generally the operating temperature of either or both of casting rolls 74 and 74', and more specifically for determining the temperature of either or both roll surfaces 74A and 74B, in accordance with the present invention, is shown. Central to system 150 is a general-purpose computer 152 that may be a conventional desktop personal computer (PC), laptop or notebook computer, or other known general purpose computer configured to operate in a manner to be described subsequently. Computer 152 has at least three analog-to-digital (A/D) inputs, one of which is connected to signal path 120, one of which is connected to signal path 117, and the other of which is connected to signal path 124. Computer 152 is thus configured to receive an analog flow rate signal produced by flow rate mechanism 115 as well as two analog temperature signals produced by temperature sensors 118 and 122, although the present invention contemplates that temperature sensors 115, 118 and 122 may alternatively be configured to produce digital signals in which case the inputs of computer 152 connected to signal paths 117, 120 and 124 may be digital inputs.

System 150 further includes a conventional memory 154 for storing information and executable software algorithms therein as is known in the art. A keyboard 156 is electrically connected to computer 152, and may be used to enter certain information relating to the operation of apparatus/process 50 into memory 154 as will be described in greater detail hereinafter. Computer 152 is also electrically connected to a conventional monitor 158, wherein computer 152 is configured to display a computed temperature of either or both of the casting rolls 74 and 74'. Monitor 158 may further be configured with touch-sensitive switches as an alternative means for entering into memory 154 information relating to the operation of apparatus/process 50. An audible or other alarm 160 is also included, and is electrically connected to computer 152, wherein alarm 160 may be activated under the direction of computer 152 in a known manner.

In one embodiment, as will be described in greater detail hereinafter, computer 152 may be configured to display information relating to the control of apparatus/process 50 based on the computed surface temperature of either, or both of, casting rolls 74 and 74'. In this embodiment, an operator of apparatus/process 50 is required to monitor the displayed information and physically take whatever action is required by the displayed information to accordingly control apparatus/process 50 as a function of casting roll surface temperature. In an alternative embodiment, computer 152 is electrically connected to the continuous strip caster apparatus/process 50 via a number, N, of signal-paths, as shown by dashed-line connection in FIG. 5, wherein N may be any positive integer. In this embodiment, computer 152 is operable to automatically control one or more operating parameters associated with apparatus/process 50 in accordance with known control techniques, and computer 152 may be configured in this embodiment to automatically modify one or more of these operating parameters based on the computed casting roll surface temperature to accordingly control apparatus/process 50 as a function of the casting roll surface temperature as will be described in greater detail hereinafter. In either case, computer 152 is further operable to activate alarm 160 whenever the casting roll surface temperature exceeds a temperature threshold.

Figure 6A:
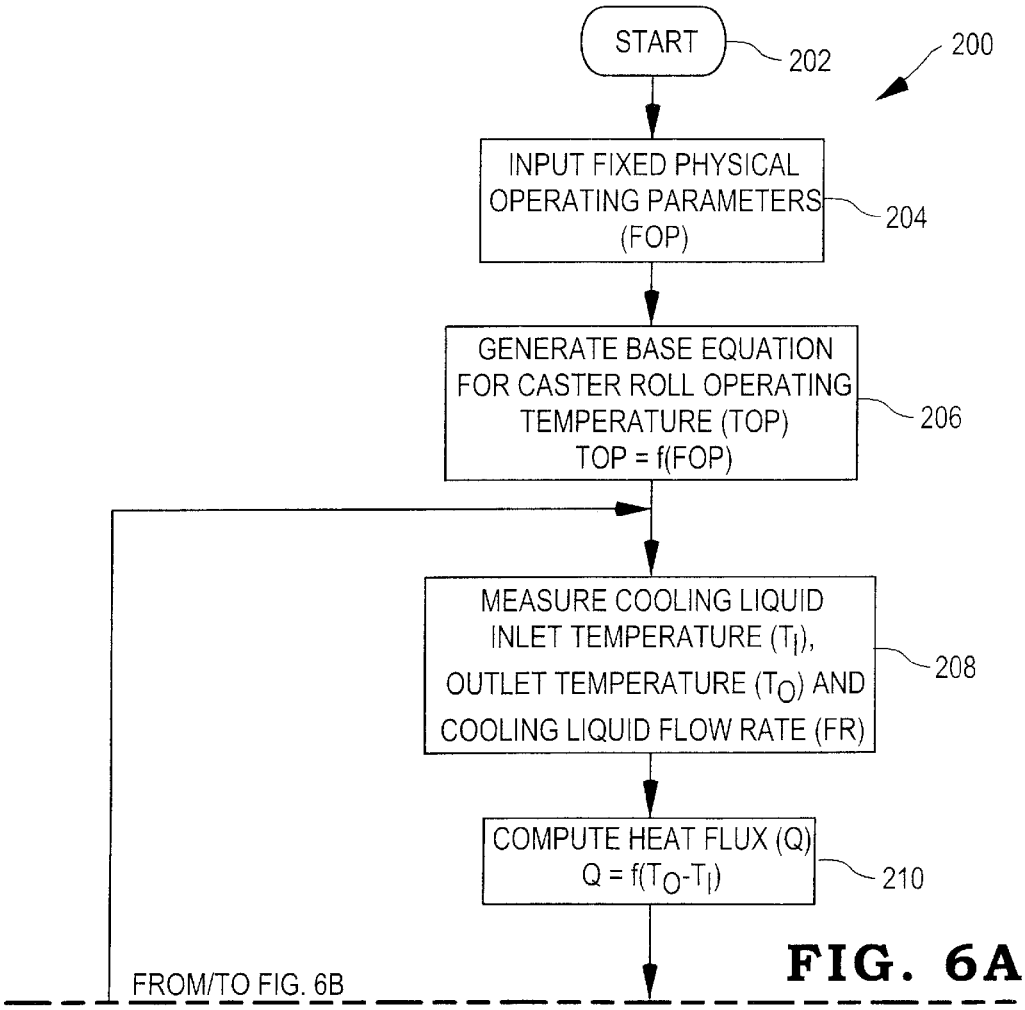
FIGS. 6A and 6B comprise a flowchart illustrating one embodiment of a software algorithm for determining the operating temperature of at least one of the twin rollers shown in FIGS. 1–4 and for providing strip casting process control information as a function thereof.
Figure 6B:
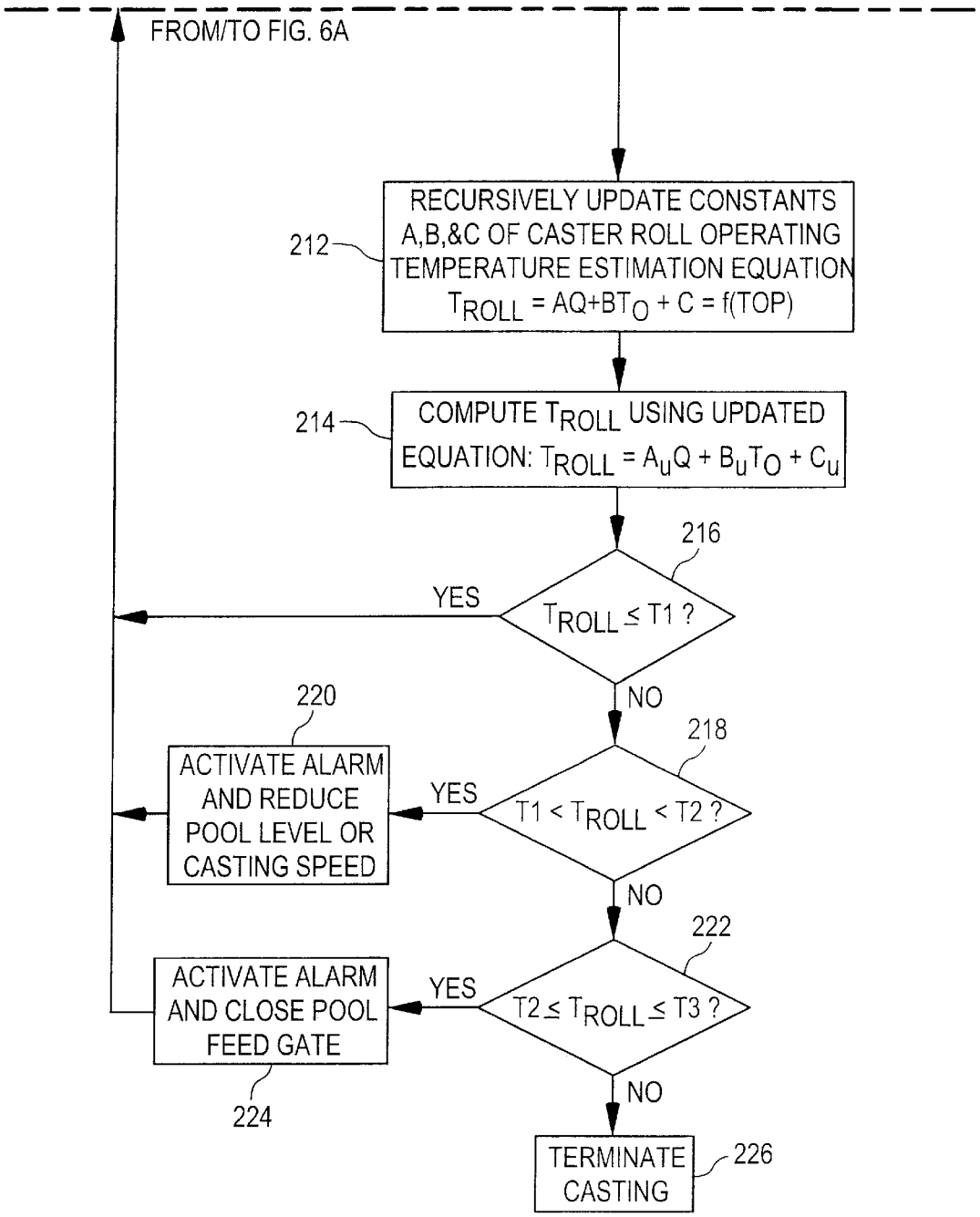

Referring now to FIGS. 6A and 6B, a flowchart is shown illustrating one preferred embodiment of a software algorithm 200 for determining the surface temperature of either or both of the casting rolls 74 and 74', and for providing information relating to the operation of apparatus/process 50 as a function of roll surface temperature, in accordance with the present invention. Algorithm 200 is stored in memory 154 and is executable by computer 152 in a known manner. Algorithm 200 begins at step 202, and at step 204 computer 152 is operable to receive a number of fixed operating parameters (FOP) corresponding to fixed physical parameters associated with apparatus/process 50 in general and with the structure and operation of the casting rolls 74, 74' and corresponding structure in particular. In one embodiment, an operator of apparatus/process 50 executes step 204 by entering such fixed operating parameter (FOP) information into memory 154 via keyboard 156, touch-screen monitor 158 and/or any other known data entry mechanism. Alternatively, such information may already reside within memory 158, and in this case step 204 may be omitted. In any case, fixed operating parameters that have been determined to be useful in determining the surface temperature of either or both of casting rolls 74 and 74', in accordance with the present invention, include, but are not necessarily limited to, the diameter, D, of the casting rolls 74 and 74' (typically in units of meters), the length, L, of the casting rolls 74 and 74' (typically in units of meters), the specific heat, SH, of the cooling liquid (typically in units of J/kg° C.), the density, DN, of the cooling liquid (typically in units of kg/m$^3$) and a variable parameter, S, relating changes in roll temperature to changes in roll diameter (typically in units of ° C./m). The diameter, D, of the rolls 74 and 74' are, over time, subject to change due to wear, machining, and the like, and the parameter S is therefore included to account for changes in heat transfer of the rolls 74 and 74' with corresponding changes in roll diameter. Generally, D and L may be easily measured, SH and DN may be found in published tables and/or be provided by a supplier of the cooling liquid, and S may generally be measurable and/or be provided by a manufacturer of casting rolls. In any case, the foregoing operating parameters generally represent fixed-valued parameters that need only be measured or otherwise ascertained once, or in the case of roll diameter, D, whenever a significant change in roll diameter has occurred, and then entered into memory 156 at step 204 of algorithm 200.

Algorithm 200 advances from step 204 to step 206 where computer 152 is operable to generate a base equation for computing caster roll surface temperature as a function of the physical and fixed operating parameter values FOP, as well as the temperature of coolant liquid entering rolls 74 and/or 74' and the temperature of coolant liquid exiting rolls 74 and/or 74'. In accordance with the present invention, such a base equation for the operating surface temperature, Top, of the casting rolls 74 and/or 74' has been developed for one embodiment of the thin strip casting apparatus/process 50, and is generally of the form:

$$T_{OP}=1197*Q/L+27.3+(T_O-35)+S*(D-0.5) \quad (1),$$

wherein Q is the total heat removed from the roll surfaces by the cooling liquid (in units of Mwatts), and wherein the constants 1197, 27.3 and 35 reflect one specific embodiment of the thin strip casting apparatus/process 50. Those skilled in the art will recognize that such constants may vary depending upon the particular thin strip casting a process in which the roll surface temperature determination system of the present invention is implemented, and that such constants will generally be readily ascertainable without undue experimentation. In any case, algorithm execution advances from step 206 to step 208 where the computer 152 is operable to measure the cooling liquid inlet temperature, $T_I$, the coolant liquid outlet temperature, $T_O$, (both 20 typically in units of ° C. ) and the flow rate of cooling liquid, FR, supplied by liquid source 110 (typically in units of m$^3$/hr). In the embodiment described hereinabove with respect to FIGS. 1–5, computer 152 is operable to execute step 208 by reading the first and second temperature signals on signal paths 120 and 124 respectively, and by reading the cooling liquid flow rate signal on signal path 117. It will be understood, however, that the present invention contemplates alternatively determining the temperature of cooling liquid entering rolls 74 and 74', the temperature of cooling liquid exiting rolls 74 and 74', and/or the flow rate of cooling fluid flowing through the caster roll cooling system via any other known mechanism or technique therefore. In any case, algorithm execution advances from step 208 to step 210 where computer 152 is operable to compute the total heat removed, Q, from the roll surfaces by the cooling liquid passing therethrough, hereinafter referred to heat flux or heat transfer, as a function of the flow rate of cooling fluid, FR, and a difference between $T_I$ and $T_O$. In one embodiment, computer 152 is operable at step 210 to compute Q according to the equation:

$$Q=FR*DN*SH*(T_O-T_I) \quad (2),$$

where DN and SH are constant terms defined hereinabove. However, those skilled in the art will recognize that computer 152 may alternatively be configured to determine Q in accordance with one or more predefined tables, charts and/or graphs relating appropriate values of Q to cooling fluid flow rate values, FR, and to temperature differential values $T_O-T_I$.

In any case, algorithm execution advances from step 210 to step 212 where computer 152 is operable to update three constants A, B and C used to define an iterative equation for computing the casting roll surface temperature, $T_{ROLL}$ that is based on equations (1) and (2) above. One embodiment of such an equation takes the form:

$$T_{ROLL}=A*Q+B*T_0+C \quad (3),$$

where Q and $T_O$ have been previously defined, and the constants A, B and C define the updatable constants. Initially, constants A, B and C are defined via appropriate algebraic manipulation of equation (1), and with each successive pass through algorithm 200, the constants A, B and C are updated based on previous values therefore and also on current Q and $T_O$ values. In one embodiment, the constants A, B and C are updated using known recursive techniques, although the present invention contemplates using other known techniques for updating these constants to updated values $A_U$, $B_U$ and $C_U$. Following step 212, algorithm 200 advances to step 214 where computer 152 is operable to compute the casting roll surface temperature, $T_{ROLL}$, according to equation (3) using the updated constant values $A_U$, $B_U$ and $C_U$; i.e., according to the equation:

$$T_{ROLL}=A_U*Q+B_U*T_O+C_U \quad (4).$$

Computer 152 is further operable at step 214 to display the present value of $T_{ROLL}$ on the monitor 158 of system 150.

Following step 214, algorithm execution advances to step 216 where computer 152 is operable to compare the casting roll surface temperature $T_{ROLL}$ computed at step 214 to a first temperature threshold T1. As long as $T_{ROLL}$ is less than or equal to T1, algorithm execution loops back to step 208. Thus, as long as $T_{ROLL}$ stays at or below T1, computer 152 is operable to continually compute $T_{ROLL}$ and display current values thereof on monitor 158.

If, at step 216, computer 152 determines that $T_{ROLL}$ has exceeded T1, algorithm 200 advances to step 218 where computer 152 is operable to compare the casting roll surface temperature $T_{ROLL}$ to a second temperature threshold T2. If $T_{ROLL}$ has exceeded T1 but is less than T2, algorithm 200 advances to step 220 where computer 152 activates alarm 160 and issues an instruction to modify one or more operating parameters associated with the thin strip casting apparatus/process 50. In one embodiment, for example, computer 152 is operable at step 220 to display a message on monitor 158 instructing an operator of apparatus/process 50 to take appropriate steps to reduce the level of the pool 92 (FIGS. 2 and 4) and/or reduce the rotational speed of the casting rolls 74 and 74'. Alternatively, in embodiments wherein computer 152 is configured to automatically control the thin strip casting apparatus/process 50, computer 152 is operable at step 220 to control apparatus/process 50 in such a manner as to reduce the level of the pool 92 and/or reduce the rotational speed of the casting rolls 74 and 74'. Either or both of these measures are intended cause the casting roll temperature to drop below the desired threshold temperature T1. In any case, algorithm 200 loops back from step 220 to step 208 to compute a new casting roll surface temperature value $T_{ROLL}$.

If, at step 218, computer 152 determines that $T_{ROLL}$ has exceeded T2, algorithm 200 advances to step 222 where computer 152 is operable to compare the casting roll surface temperature $T_{ROLL}$ to a third temperature threshold T3. If $T_{ROLL}$ has exceeded T2 but is less than T3, algorithm 200 advances to step 224 where computer 152 is operable to activate alarm 160 and to issue an instruction to modify another one or more operating parameters associated with the thin strip casting apparatus/process 50. In one embodiment, for example, computer 152 is operable at step 224 to display a message on monitor 158 instructing an operator of apparatus/process 50 to take appropriate steps to close the pool feed gate; i.e., by closing nozzle 86, tundish valve 81 (see FIG. 2) or the like. Alternatively, in embodiments wherein computer 152 is configured to automatically control the steel strip casting apparatus/process 50, computer 152 is operable at step 224 to control apparatus/process 50 in such a manner as to close the pool feed gate as just described. This measure is intended to interrupt the flow of molten material to the pool 92 to thereby allow the cooling liquid flowing through the casting rolls 74 and 74' to reduce the surface temperature thereof. In any case, algorithm 200 loops back from step 224 to step 208 to compute a new casting roll operating temperature value $T_{ROLL}$.

If, at step 222, computer 152 determines that $T_{ROLL}$ has exceeded T3, algorithm 200 advances to step 226 where computer 152 is operable in one embodiment to display a message on monitor 158 instructing an operator of apparatus/process 50 to take appropriate steps to terminate the operation of apparatus/process 50 to thereby terminate the thin strip casting operation. Alternatively, in embodiments wherein computer 152 is configured to automatically control the steel strip casting apparatus/process 50, computer 152 is operable at step 226 to automatically terminate the operation of apparatus/process 50. Temperature threshold T3 is generally chosen such that a casting roll surface temperature above T3 indicates dangerous or uncontrolled operation of apparatus/process 50 requiring immediate termination of the apparatus/process 50 to prevent damage to and/or destruction of the apparatus/process 50.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, steps 216, 218 and 222 may be modified to replace the casting roll surface temperature $T_{ROLL}$ with the cooling liquid outlet temperature $T_O$, such that computer 152 is accordingly operable to monitor the outlet temperature of cooling liquid exiting the casting rolls 74 and 74' rather than the casting roll surface temperature. In this embodiment, the surface temperature thresholds T1, T2 and T3 described hereinabove would be mapped to appropriate outlet temperature thresholds T1–T3 using the correlation equation (4) above. Steps 220, 224 and 226 would then be executed if/when the cooling liquid outlet temperature exceeds the various outlet temperature thresholds T1–T3. Such modifications to algorithm 200 are well within the knowledge of a skilled artisan, and could easily be implemented without undue experimentation.

What is claimed is:

1. A method of monitoring surface temperature of at least one casting roll of a thin strip casting process, the method comprising the steps of:

determining an inlet temperature ($T_I$) and an outlet temperature ($T_O$) of cooling liquid circulated through a cooling system of the at least one casting roll;

computing a heat flux value (Q) as a function of the inlet and outlet temperatures, the heat flux value indicative of an amount of heat removed from the at least one casting roll by the cooling system;

developing a correlation between the surface temperature of the at least one casting roll ($T_{ROLL}$), the heat flux value and the outlet temperature;

mapping a first threshold surface temperature to a first threshold outlet temperature using the correlation;

monitoring the outlet temperature; and generating a signal if the outlet temperature exceeds the first threshold outlet temperature, the signal thereby indicative of the surface temperature of the at least one casting roll exceeding the first threshold surface temperature.

2. The method of claim 1 further including the step activating an alarm if the outlet temperature exceeds the first threshold outlet temperature.

3. The method of claim 1 further including the step of reducing one of a pool level of molten material within the thin strip casting process and a casting speed of the at least one casting roll if the outlet temperature exceeds the first threshold outlet temperature.

4. The method of claim 3 further including the steps of:

mapping a second threshold surface temperature greater than the first threshold surface temperature to a second threshold outlet temperature greater than the first threshold outlet temperature using the correlation; and activating an alarm if the surface temperature exceeds the second threshold outlet temperature.

5. The method of claim 4 further including the step of discontinuing a flow of molten material within the thin strip casting process if the surface temperature exceeds the second threshold outlet temperature.

6. The method of claim 5 further including the steps of:

mapping a third threshold surface temperature greater than the second threshold surface temperature to a third threshold outlet temperature greater than the second threshold outlet temperature using the correlation; and terminating the thin strip casting process if the surface temperature exceeds the third outlet temperature threshold.

7. The method of claim 1 wherein the step of computing a heat flux value (Q) includes computing the heat flux value further as a function of a number of physical properties associated with the cooling liquid.

8. The method of claim 1 wherein the step of computing a heat flux value includes computing the heat flux value according to the equation $Q=FR*DN*SH*(T_O-T_I)$, where FR is the flow rate of the cooling liquid, DN is the density of the cooling liquid and SH is the specific heat of the cooling liquid.

9. The method of claim 1 wherein the step of developing a correlation includes developing a correlation according to the equation $T_{ROLL}=A*Q+B*T_O+C$, where A, B and C are constants dependent upon operating conditions of the thin strip casting process.

10. The method of claim 1 further including the step of causing the generated signal to vary operating parameters of the thin strip casting process to reduce the surface temperature of the at least one casting roll.

11. The method of claim 1 further including the step of determining a flow rate of the liquid circulated through the cooling system;

and wherein the step of computing a heat flux value includes computing the heat flux value further as a function of the flow rate of the liquid circulated through the cooling system.

12. The method of claim 11 further including the step of generating a signal if the surface temperature exceeds a first threshold temperature.

13. The method of claim 12 further including the step of activating an alarm if the surface temperature exceeds the first threshold temperature.

* * * * *

UNITED STATES PATENT AND TRADEMARK OFFICE

CERTIFICATE OF CORRECTION

PATENT NO. : 6,588,493 B1
DATED : July 8, 2003
INVENTOR(S) : Walter Blejde and Rama Mahapatra It is certified that error appears in the above-identified patent and that said Letters Patent is hereby corrected as shown below:

Title page,
Item [12], Title, reads "Walter Bleide" should read -- Walter Blejde --.

Signed and Sealed this

Eleventh Day of May, 2004

JON W. DUDAS
*Acting Director of the United States Patent and Trademark Office*